US005458046A

United States Patent [19]

Blenk et al.

[11] Patent Number: 5,458,046

[45] Date of Patent: Oct. 17, 1995

[54] BREECH MECHANISM FOR A FIREARM, ESPECIALLY A REPEATER WEAPON

[75] Inventors: Gerhard Blenk, Wertach; Meinrad Zeh, Isny, both of Germany

[73] Assignee: Horst Blaser Jagdwaffenfabrik, Isny, Germany

[21] Appl. No.: 200,228

[22] Filed: Feb. 23, 1994

[30] Foreign Application Priority Data

Feb. 25, 1993 [DE] Germany ..... 9302692 U

[51] Int. Cl.[6] ..... F41A 3/42

[52] U.S. Cl. ..... 89/190; 42/16

[58] Field of Search ..... 89/176, 190, 168; 42/16

[56] References Cited

U.S. PATENT DOCUMENTS

| | | | |
|---|---|---|---|
| 1,057,329 | 3/1913 | Clarus | 89/190 |
| 2,370,189 | 2/1945 | Penney | 89/190 |
| 2,861,374 | 11/1958 | Hampton | 89/190 |
| 4,135,434 | 1/1979 | Hurlemann et al. | 89/190 |
| 5,259,137 | 11/1993 | Blenk et al. | 42/16 |

FOREIGN PATENT DOCUMENTS 596649 5/1934 Germany .

*Primary Examiner*—Stephen M. Johnson
*Attorney, Agent, or Firm*—Flynn, Thiel, Boutell & Tanis

[57] ABSTRACT

In the breech mechanism for a firearm the receiver (2) attached to the barrel has a radially inwardly directed conical locking shoulder (16). A breech head (9) and a locking sleeve (7) are arranged in a slider (3) slidable relative to the breech housing (1) in the barrel direction. The locking sleeve (7) is divided into a plurality of spring tongues (**7*b*), each of which carries a locking element (13) with radially inwardly and outwardly directed cone sections. A spreading cone is arranged in the vicinity of the front end (9*a*) of the breech head (9) and cooperates with the locking elements (13). An actuating lever (18) is arranged on the slider, connected to a pivot shaft (17). The pivot shaft (17) is connected to a locking lever (19). A two-armed intermediate lever (20) is pivotally mounted on the slider (3) behind the locking lever (19), pivoting about an axis (20*a*) parallel to the pivot shaft (17) and cooperating with an abutment (22) arranged on the breech housing (1). The free end (19*a*) of the locking lever (19) so cooperates with the first lever arm (21) of the intermediate lever (20) that, on sliding the slider forwards, the first lever arm (21) comes into position between the abutment (22) and the free end (19*a*) and the free end (19*a*) can move over a dead center position defined by the connecting line between the point of engagement of the first lever arm (21) with the abutment (22) and the center of the pivot shaft (17**).

6 Claims, 4 Drawing Sheets

BREECH MECHANISM FOR A FIREARM, ESPECIALLY A REPEATER WEAPON

FIELD OF THE INVENTION

This invention relates to a breech mechanism for firearm, especially a repeater weapon, with a breech housing, a receiver attached to the barrel and having a radially inwardly directed, conical locking shoulder at the junction with the cartridge holder, a substantially cylindrical breech head slidable in the direction of the barrel relative to the breech housing, with a plurality of radially movable locking elements in the form of annular parts which have radially outwardly directed cone sections and are arranged in the region of the front end of the breech head, the cone sections bearing on the locking shoulder in the locked position and having radially inwardly directed cone sections with which they bear on a spreading cone, a locking sleeve concentrically surrounding the breech head and slidable axially to a limited extent relative thereto, which sleeve cooperates with the locking elements, and with an actuating device for sliding the locking sleeve forward axially relative to the breech head, with the breech mechanism closed.

DESCRIPTION OF THE RELATED ART

With such a known breech mechanism (DE 596 649) the locking elements are annular parts of a hollow, cylindrical body of rotation. In order to obtain the individual locking elements a closed hollow cylinder is first made and this is then cut up. This has the disadvantage that a plurality of loose locking elements result for each breech mechanism, which require a lot of assembly effort in manufacture and servicing. Moreover an additional sleeve or the like surrounding the locking elements on the outside is necessary, since the locking elements will otherwise fall out with the breech mechanism open. Furthermore, when opening the breech mechanism, an increased expenditure of force is necessary in order to pull the breech head back out of the receiver, since the locking elements have to be pressed radially inwards by the conical locking shoulder, which is made difficult by powder residues which increase the friction. The form of the actuating device is not found in DE 596 649.

The invention is therefore based on the object of providing a breech mechanism for firearms of the kind initially defined, which consists of fewer individual parts, in which the locking elements do not require any additional assembly effort, in which a smaller expenditure of force is needed for opening and in which the actuating device works easily and with reliability in operation.

SUMMARY OF THE INVENTION

This achieved according to the invention in that:

a) the locking sleeve is divided from its front end by a plurality of longitudinal slots into a plurality of spring tongues and each spring tongue carries a locking element integral therewith at the free, front end, b) the radially inwardly directed cone sections are provided on the front ends of the locking elements, c) the spreading cone is arranged in the vicinity of the front end of the breech head, d) the breech head and the locking sleeve are arranged in a slider sliding relative to the breech housing and the locking sleeve is fixedly connected to the slider, e) an actuating lever connected to a pivot shaft arranged transverse to the barrel axis is mounted on the slider, f) the pivot shaft is connected to a locking lever, g) a two-armed intermediate lever is arranged on the slider behind the locking lever, pivoting about an axis parallel to the pivot shaft and cooperating with an abutment arranged on the breech housing, and h) the free end of the locking lever so cooperates with the first lever arm of the intermediate lever that, when the slider slides forward, the first lever arm comes into position between the abutment and the free end and the free end can move over a dead center position defined by the connecting line between the point of engagement of the first lever arm with the abutment and the center of the pivot shaft.

The invention is based on the idea that the locking elements are formed as components of the locking sleeve, in one piece therewith. In this way the expense of manufacture is reduced, since the locking elements are connected fast to the locking sleeve by the spring tongues and no additional sleeve is needed to retain the locking elements with the breech mechanism open. Since the locking elements are fixedly connected to the locking sleeve by the spring tongues, they can be mounted together with the locking sleeve with no additional assembly work. They also cannot be lost when cleaning the breech mechanism. Also a smaller expenditure of force is needed to open the breech mechanism. Thus, when opening the breech mechanism, the locking elements are moved radially inwards by the spring tongues and thus do not hinder the opening of the breech mechanism.

Simple, smooth and operational reliable operation of the breech mechanism is possible by means of the actuating lever (chamber grip) movable forwards and backwards on the slider. When the slide has been pushed far enough forward by the actuating lever for the locking elements of the locking sleeve to be located within the receiver, the intermediate lever releases the locking lever and pivots against the abutment. By virtue of the special form of the locking lever and intermediate lever, the force which pushes the slider additionally forward is stepped up, whereby on the one hand a stiff cartridge is pushed into the cartridge holder and on the other hand the locking sleeve is brought into its locking position. The stepping up of the force allows the breech mechanism to be actuated easily, since the locking lever is moved over a dead center position in the pushing forward of the actuating lever, the breech mechanism is also reliably locked.

Advantageous developments of the invention are characterized in the dependent claims.

BRIEF DESCRIPTION OF THE DRAWINGS

The invention is explained in more detail below with reference to an embodiment shown in the drawings, in which.

DETAILED DESCRIPTION

The invention is explained in more detail below in relation to a breech mechanism for a repeater weapon. The breech mechanism can however also be used for other firearms.

Figure 4:
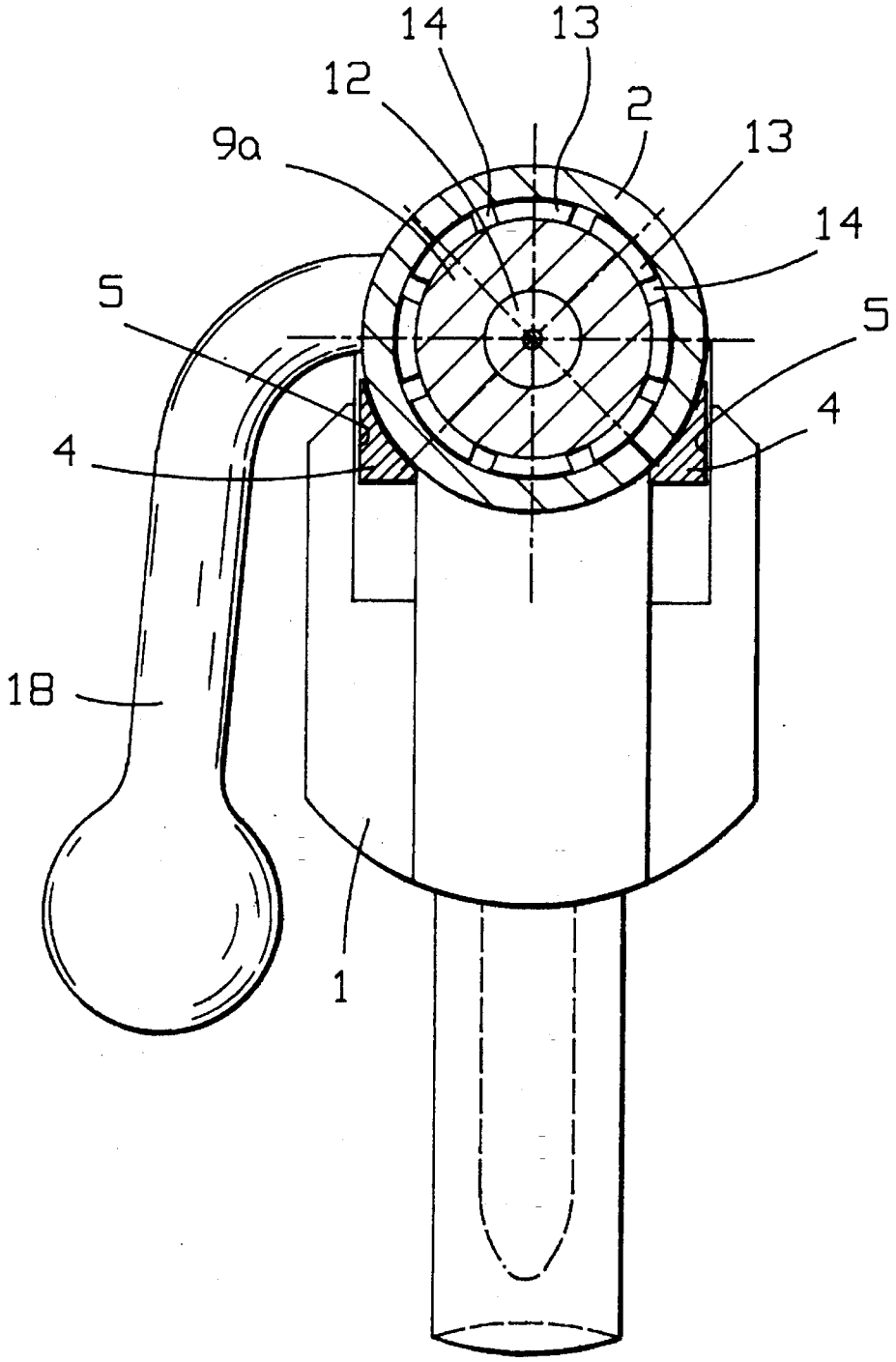
FIG. 4 is a cross-section on the line IV—IV in FIG. 2.

The breech housing 1 is connected in usual manner to the receiver 2 of the barrel provided at the rear end of the barrel. The slider 3 is fixed to two rails 4 which are for their part slidable in the direction of the barrel axis in guides 5 of the breech housing 1 (FIG. 4). The slider 3 is in this manner movable in the barrel direction relative to the breech housing 1. The rear end 7*a* of the locking sleeve 7 is arranged in a longitudinal bore 6 in the slider 3 and is fixed relative to the slider 3 by means of a transverse part 8. The locking sleeve 7 is thus fixedly connected to the slider 3. It surrounds the cylindrical breech head 9 concentrically. The breech head 9 can slide axially by a small amount within the locking sleeve 7. The sliding movement is limited by the transverse part 8, which engages in a slot 10 in the breech head 9. The firing pin 12 is slidable in a longitudinal bore 11 in the breech head 9.

The locking sleeve 7 is divided from the front end into a plurality of spring tongues 7*b* by a plurality of longitudinal slots 14. Each spring tongue 7*b* carries a locking element 13 at its front end, in the form of a part of an annulus. The locking elements are in one piece with the respective spring tongues 7*b* and thus with the locking sleeve 7. The locking elements 13 form a ring composed of annular pieces, interrupted only by the slots 14. There are preferably eight to ten such longitudinal slots 14. The axial length of the longitudinal slots advantageously amounts to at least twice the diameter of the locking sleeve 7, in order that the spring tongues 7*b* shall have sufficient spring properties. The locking sleeve is made from steel.

The breech head 9 comprises a spreading cone 15 in the vicinity of its front end 9*a*, the cone tapering to the rear. The locking elements 13 bear on the conical surface of this spreading cone 15, by means of radially inwardly directed cone sections 13*a*. On their sides opposite to the cone sections 13*a* the locking elements 13 have rearwardly directed cone sections 13*b*, which cooperate with a locking shoulder 16 on the receiver 2 in the locked position. The locking shoulder 16 is formed by an closed cone surface.

Figure 1:
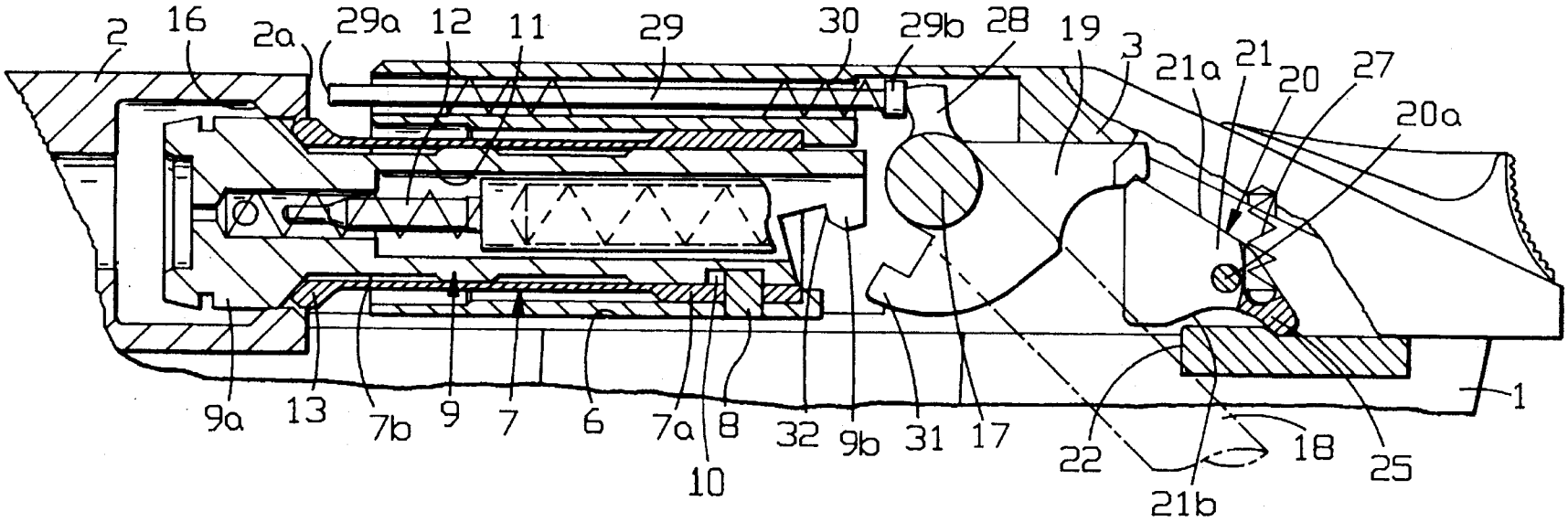
FIG. 1 is an axial section of the partially opened breech mechanism.

A pivot shaft 17 of the actuating lever 18 connected fast thereto is arranged transverse to the barrel axis and is pivotally mounted in a transverse bore of the slider 3. The pivot shaft 17 is connected to a locking lever 19. A two-armed intermediate lever 20 is pivotally mounted in the slider 3 behind the locking lever 19, on an axis 20*a* parallel to the pivot shaft. The intermediate lever 20 has a first lever arm 21, one side 21*a* of which cooperates with the locking lever 19 and the other side 21*b* of which cooperates with an abutment 22. The abutment 22 is fixed to the breech housing 1. A detent 23 is provided at the free end 19*a* of the locking lever 19 and a counter-detent 24 is provided on the first lever arm 21 and engages with the detent 23 in the open position of the actuating lever, as shown in FIG. 1. The second lever arm 25 of the intermediate lever 20 cooperates with a control cam track 26 arranged on the breech housing behind the abutment 22. A compression spring 27 moreover presses on this second lever arm 25.

A cam 28 is also connected to the pivot shaft 17 and acts on a release pin 29 slidable in the slider 3 in the barrel direction, its front end 29*a* cooperating with the rear end 2*a* of the receiver 2. The release pin 29 is surrounded by a compression spring 30, which bears at one end on the slider 3 and at the other end on the head 29*b* of the release pin 29 and thus urges the release pin 29 to the rear in the barrel direction. The compression spring 30 thus exerts a turning moment acting on the pivot shaft 17 in the arrow direction M, i.e. in the unlocking sense.

A hook 31 is also connected to the pivot shaft 17 and engages in a recess 32 at the rear end 9*b* of the breech head 9 in the locking position of the actuating lever 18.

Figure 2:
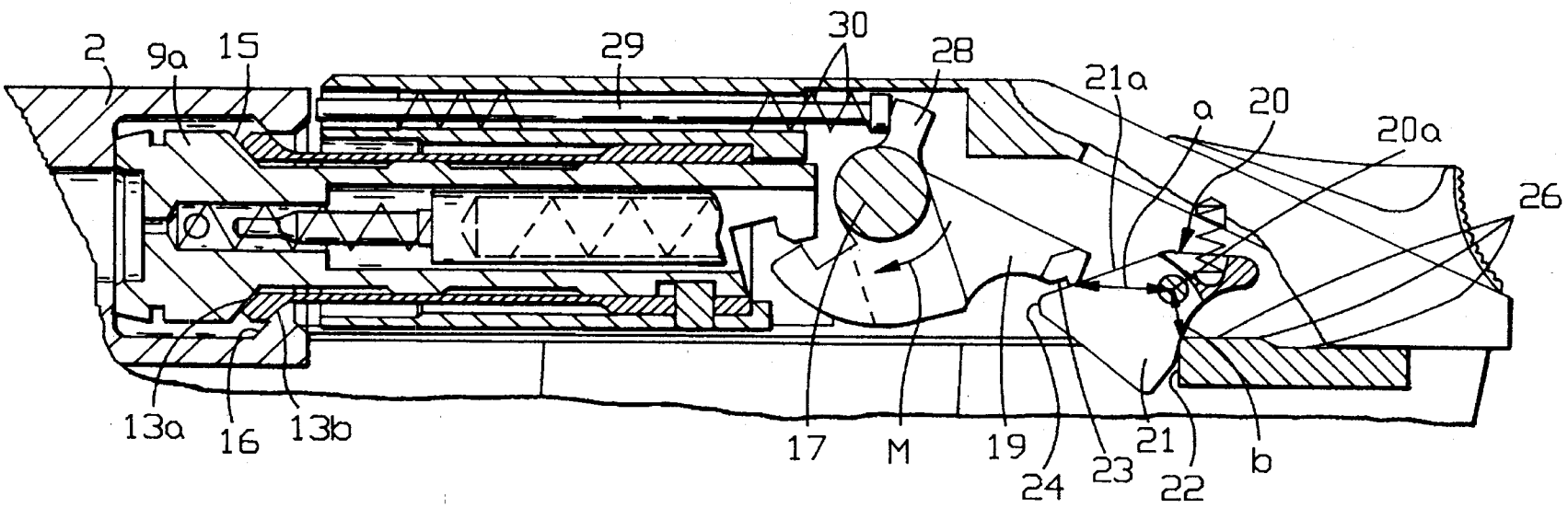
FIG. 2 is an axial section of the locked breech mechanism.
Figure 3:
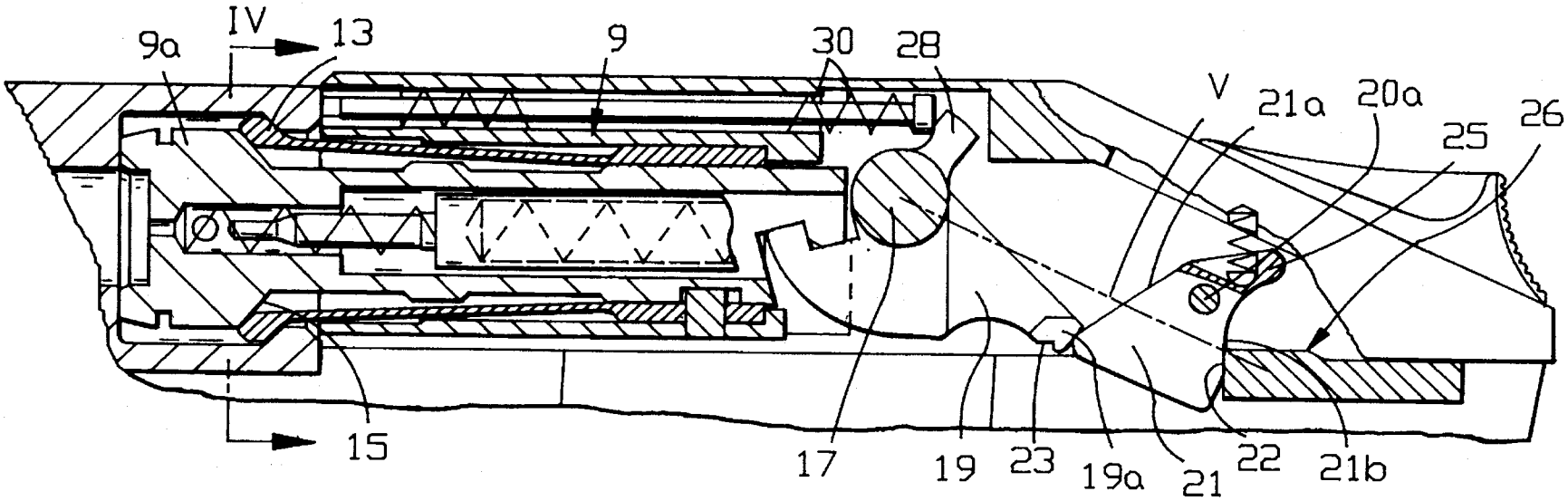
FIG. 3 shows a position intermediate between FIGS. 1 and 2.

The manner of operation of the breech mechanism is as follows:

With the breech mechanism wholly or partially open the parts thereof assume the position shown in FIG. 1. The actuating lever 18, which is shown in FIG. 1 in chain dotted lines, is then swung to the rear, whereby the locking lever 19 is pivoted up so far that its detent 23 is engaged with the counter-detent 24 of the first lever arm 21. The actuating lever 18 is blocked from turning by this engagement and the slider 3 can be shifted back and forth by grasping the actuating lever 18. When the slider 3 has reached the forwardly displaced position shown in FIG. 1, the second lever arm 25 is pushed up by the control cam track 26 against the compression spring 27. The first lever arm 21 is thereby pivoted down and the detent action on the locking lever 19 is thereby released. In the forward pivoting of the actuating lever 18, the free end 19*a* of its locking lever 19 presses on the upper side 21*a* of the first lever arm 21, whereby its second side 21*b* bears on the abutment 22. Since the distance a of the point of engagement of the free end 19*a* on the first lever arm 21 from the axis 20*a* is greater than the distance b of the abutment 22 from the axis 20*a*, the force is stepped up and a forwardly directed force is also exerted on the slider 3 by the lever arm 21. This force backs up the forwardly directed finger force acting on the locking lever 19, so that the front end 9*a* of the breech head 9 is pushed fully into the receiver 2 and the cartridge, not shown, is also pushed into the cartridge holder. Further forward movement of the breech head 9 is thus prevented, as is shown in FIG. 3. With further forward movement of the slider 3 this moves the locking sleeve fixed thereto by the transverse part 28 relative to the breech head 9. The spreading cone 15 urges the locking elements 13 radially outwards, so that they bear on the locking shoulder 16 of the receiver 2 and thus also bear on the rear on the front end 9*a* of the breech head 9. In the movement of the slider 3 forwards from the position shown in FIG. 3 into the locking position shown in FIG. 2, the free end 19*a* of the locking lever 19 presses constantly on the lever arm 21 and finally reaches the locking position shown in FIG. 2. During the forward or downward pivoting of the locking lever 19, its free end 19*a* moves over the dead center position determined by the connecting line V between the point of abutment of the lever arm 21 on the abutment 22 and the center of the pivot shaft 17. Through the movement of the locking lever 19 over the dead center position the locking sleeve 7 is held in its locking position. The compression spring 30 acting via the head 29*b* of the release pin 30 does not only serve to hold the locking lever 19 in its over-center position but it also assists the forwards movement of the actuating lever 18. The locking lever 19 is additionally retained in its over-center position by the hook 31 which engages in the recess 32 at the rear end 9*b* of the breech head. The locking is thereby additionally secured.

In order to open the breech mechanism, the actuating lever 18 is pivoted to the rear. The cam 28 thus presses on the release pin 29, which bears on the rear end 2*a* of the receiver 2. The slider 3 is pushed to the rear by this and carries with it the locking sleeve fixedly connected thereto, while the breech head 9 initially remains in its previous position. As a result the locking elements 13 slide to the rear and radially inwards on the spreading cone 15, whereby the spring tongues 7*b* of the locking sleeve 7 bear on the outer peripheral surface of the breech head 9 by virtue of their elasticity. With further movement of the slider 3 to the rear, the transverse part also entrains the breech head 9 and pulls this, together with the locking sleeve 7 out of the receiver 2. The slider 3 can be moved further to the rear by means of the actuating lever 18, whereby a cartridge ejector, not shown, provided on the front end 9*a* of the breech head 9, pulls the cartridge case out of the cartridge holder of the barrel.

With the movement of the slider 3 to the rear, the abutment 2 bearing on the side 21*b* of the lever arm 21 presses the lever arm 21 upwards and thus turns the intermediate lever 20 clockwise. This pivotal movement in the clockwise sense continues until the side 21*b* also comes into the region of the control cam track 26 above the abutment 20. The pivotal movement of the intermediate lever 20 is therefore positively controlled by the abutment 22 and the control cam track 26, the spring 27 supporting this pivotal movement in the clockwise sense. As a result of this positive control, the breech mechanism remains operative even if the spring 27 should break. As soon as the intermediate lever 20 has been pushed back fully, the detent 23 of the locking lever 19 clicks into the counter-detent 24 of the lever arm 21 and the actuating lever is again blocked from turning movement.

It should also be mentioned that the control cam track, not shown, is connected to the pivot shaft 17 and engages at the beginning of the opening movement of the actuating lever 18 on a retaining piece (trigger sear) connected to the firing pin and thus re-cocks the firing spring.

We claim:

1. In a breech mechanism for a firearm having a barrel, a breech housing, a hollow receiver and a substantially cylindrical breech head, said barrel, breech housing, receiver and breech head each having a front end and a rear end, the front end of said receiver being attached to a rear end of the barrel which said barrel extends forwardly toward said front end thereof and said receiver further being attached to the breech housing which said breech housing extends rearwardly toward the rear end thereof, said receiver having a radially inwardly directed, conical locking shoulder formed about an interior surface thereof, the substantially cylindrical breech head having a spreading cone formed about an outer peripheral surface of said breech head proximate said front end, said breech head being slidable relative to the breech housing along a first path in a direction of a longitudinal barrel axis of the barrel and between a locked position with said front end disposed within said receiver and an unlocked position away from said receiver, said breech mechanism further including a locking sleeve which concentrically surrounds the breech head and includes a front end, a rear end and a plurality of radially movable locking elements formed as annular parts proximate the front end of said locking sleeve which locking elements have radially outwardly directed cone sections and radially inwardly directed cone sections that are arranged proximate the front end of the breech head, each of said radially outwardly directed cone sections being adapted to bear on the locking shoulder of the receiver when said breech housing is in the locked position and each of said radially inwardly directed cone sections adapted to bear on said spreading cone, the locking sleeve being slidable axially relative to the breech head along a second path having a limited length relative to said first path, which locking sleeve cooperates with an actuating device for sliding the locking sleeve forward axially relative to the breech head along said second path, with the breech mechanism closed, comprising the improvement wherein:

a) the locking sleeve is divided at the front end thereof by a plurality of longitudinal slots into a plurality of spring tongues, each said spring tongue terminating at a free, front end which defines the front end of the locking sleeve and including at least one said locking element formed integral therewith at the free, front end of the spring tongue, b) the radially inwardly directed cone sections are provided on front ends of the locking elements, c) said breech mechanism includes a hollow slider within said breech housing which is slidable relative to the breech housing wherein the breech head and the locking sleeve are arranged in said slider and the locking sleeve is fixedly connected to the slider so that said breech head is slidable along said first path by movement of said slider, d) said actuating device comprises an actuating lever connected to a first pivot shaft which is arranged transverse to the longitudinal barrel axis and is mounted on the slider, e) the first pivot shaft is connected to a locking lever which has a free end projecting away from said pivot shaft, f) a two-armed intermediate lever connected to a second pivot shaft is arranged on the slider rearwardly from the locking lever and has first and second lever arms, said intermediate lever pivotable about an axis of said second pivot shaft parallel to the first pivot shaft and cooperating through said first lever arm with an abutment arranged on the breech housing, and g) the free end of the locking lever cooperates with the first lever arm of the intermediate lever so that, when the slider slides forward, the first lever arm comes into a position between the abutment and the free end of the locking lever, and the free end can move beyond a dead center position defined by a connecting line extending between a point of engagement of the first lever arm with the abutment and a center of the first pivot shaft.

2. A breech mechanism according to claim 1, wherein a detent is provided at the free end of the locking lever and wherein a counter-detent is provided on the first lever arm of the intermediate lever and engages with the detent in an open position of the actuating lever.

3. A breech mechanism according to claim 2, wherein the second lever arm of the intermediate lever cooperates with a control cam track arranged on the breech housing, wherein on entry of the locking elements into the receiver as said breech housing is moved toward said locked position, the intermediate lever pivots and the first lever arm thereof is thereby swung forward to release the detent engagement.

4. A breech mechanism according to claim 1, wherein the actuating lever.

5. A breech mechanism according to claim 1, wherein a cam is connected to the first pivot shaft and acts on a release pin which is slidable in the slider in the direction of the longitudinal barrel axis, a front end of the release pin cooperating with the rear end of the receiver, and a compression spring acting on the release pin and pressing said release pin rearwardly against the cam.

6. A breech mechanism according to claim 1, wherein a hook is connected to the pivot shaft and engages with a clamping action in a recess in the rear end of the breech head in the locked position.

* * * * *

UNITED STATES PATENT AND TRADEMARK OFFICE

CERTIFICATE OF CORRECTION

PATENT NO. 5 458 046

DATED October 17, 1995

INVENTOR(S) Gerhard BLENK et al

It is certified that error appears in the above-indentified patent and that said Letters Patent is hereby corrected as shown below:

Column 6, line 51; after "lever" insert
---can swing to the rear against
a spring bias---.

Signed and Sealed this

Twenty-first Day of May, 1996

Bruce Lehman

*Attest:*

BRUCE LEHMAN

*Attesting Officer*

*Commissioner of Patents and Trademarks*